US007108487B2

(12) United States Patent
Koba et al.

(10) Patent No.: US 7,108,487 B2
(45) Date of Patent: Sep. 19, 2006

(54) FUEL SUPPLY SYSTEM INSTALLED INSIDE FUEL TANK

(75) Inventors: Takashi Koba, Kariya (JP); Keiichi Yamashita, Kariya (JP); Tatsuo Sakai, Kariya (JP)

(73) Assignee: Denso Corporation, Kariya (JP)

( * ) Notice: Subject to any disclaimer, the term of this patent is extended or adjusted under 35 U.S.C. 154(b) by 433 days.

(21) Appl. No.: 10/645,667

(22) Filed: Aug. 22, 2003

(65) Prior Publication Data

US 2004/0037714 A1 Feb. 26, 2004

(30) Foreign Application Priority Data

Aug. 22, 2002 (JP) ..... 2002-241683
Jun. 27, 2003 (JP) ..... 2003-184586

(51) Int. Cl.
*F04B 17/00* (2006.01)
*F04B 35/00* (2006.01)

(52) U.S. Cl. ..... 417/360

(58) Field of Classification Search ..... 417/360, 417/423.3; 137/576, 572, 574; 123/509, 123/514, 510
See application file for complete search history.

(56) References Cited

U.S. PATENT DOCUMENTS 4,694,857 A * 9/1987 Harris ..... 137/565.24
4,807,582 A * 2/1989 Tuckey ..... 123/514
5,769,061 A * 6/1998 Nagata et al. ..... 123/509
5,992,394 A * 11/1999 Mukaidani et al. ..... 123/509
6,305,417 B1 * 10/2001 Kleppner et al. ..... 137/565.34
6,604,511 B1 * 8/2003 Hazama ..... 123/509
6,606,980 B1 * 8/2003 Walter ..... 123/509

* cited by examiner

*Primary Examiner*—Tae Jun Kim
*Assistant Examiner*—Vikansha Dwivedi
(74) *Attorney, Agent, or Firm*—Nixon & Vanderhye P.C.

(57) ABSTRACT

A fuel supply system has a cover, a pump unit, and metal pipes. The cover and the pump unit are connected through the use of the metal pipes so as to be moved relatively each other. A case cover, covering the pump unit, has supporting portions, each of which has a through hole. Each metal pipe is inserted through the through hole and thereby guided to be moved in its axial direction inside the supporting portion. The supporting portion has a plurality of grooves. Therefore, sliding resistance between the metal pipe and the supporting portion is reduced, that is, the pump unit can be smoothly moved relatively to the cover.

8 Claims, 5 Drawing Sheets

FUEL SUPPLY SYSTEM INSTALLED INSIDE FUEL TANK

CROSS REFERENNCE TO RELATED APPLICATION

This application is based on Japanese Patent Applications No. 2002-241683 filed on Aug. 22, 2002 and No. 2003-184586 filed on Jun. 27, 2003, the disclosures of which are incorporated herein by reference.

FIELD OF THE INVENTION

The present invention relates to a fuel supply system installed in a fuel tank.

BACKGROUND OF THE INVENTION

A fuel supply system installed in a fuel tank is, for example, described in a patent document of JP-A-H11-101166. This fuel supply system has a cover, a pump unit and metal pipes. The cover is fastened to an opening of a fuel tank. The cover and the pump unit are connected through the use of the metal pipes, and thereby the pump unit is stored inside the fuel tank. The pump unit has a fuel pump, which is stored in a sub-tank to be installed inside the fuel tank. Moreover, the cover and the pump unit are biased by springs so as to be drawn apart each other. One end of each metal pipe is fastened to the cover and the other end thereof is movably supported by the pump unit. That is, the pump unit can be moved in the axial direction of the metal pipe relatively to the cover. Therefore, in case the inner pressure of the fuel tank is changed on the ground of the alternation of the temperature, or the amount of the fuel is changed, and thereby the fuel tank is expanded or contracted, the pump unit is biased into the bottom of the fuel tank integrally with the sub-tank by force of the springs.

The cover has cylindrical supporting portions, each of which has a though hole. The metal pipes are inserted through respective through holes, and thereby the pump unit is guided to be moved relatively to the cover. In case the metal pipes and the supporting portions are made of the same material, noisy sounds are generated when the metal pipes are moved inside the supporting portion. Therefore, the metal pipes and the supporting portions are respectively made of different materials, and thereby the noisy sounds are restricted to be generated.

However, for example, when the metal pipes are made of metal, the solidity of which is high, and the supporting portions are made of resin, the solidity of which is low, sliding resistances between the metal pipes and the supporting portions are disadvantageously heightened. When the sliding resistances are heightened, the pump unit cannot be moved in accordance with the expansion and the contraction of the fuel tank. Accordingly, fuel suctioning performance of the fuel supply system is likely to be lowered.

It is considered that the surfaces of the metal pipes are advantageously processed. However, depending on the shape of the fuel tank, or depending on the expansion or the contraction of the fuel tank, the axes of the metal pipes are not always disposed perpendicularly to an inner bottom surface of the fuel tank. When the metal pipe is not perpendicular to the inner bottom surface of the fuel tank, the metal pipe is declined inside the supporting portion, and thereby only some parts of the metal pipe contact some parts of the supporting portion forcefully. In this case, even though the surface of the metal pipe is advantageously processed, the sliding resistance between the metal pipe and the supporting portion increases.

For example, as shown in FIG. 8, when a part of a metal pipe 101 contacts a supporting portion 100 around its upper end 100*a*, the other part of the metal pipe 101 contacts the supporting portion 100 around its lower end 100*b*. Since these contacting areas of the metal pipe 101 and the supporting portion 100 are small, loads are concentrated on the contacting areas. Therefore, the metal pipe 101 cannot be smoothly moved inside the supporting portion 100, that is, the pump unit cannot be smoothly moved relatively to the cover.

SUMMARY OF THE INVENTION

In view of the foregoing problems, the purpose of the present invention is to provide a fuel supply system having a pump unit that can be smoothly moved relatively to a cover of the fuel supply system.

According to the present invention, each supporting portion for supporting a corresponding metal pipe has a groove. The groove is formed in an inner periphery of the supporting portion, on which the metal pipe is slidably moved. Accordingly, when the metal pipe is leaned inside the supporting portion, the contacting areas of the metal pipe and the supporting portion are reduced, and thereby the sliding resistance between the metal pipe and the supporting portion is reduced. Therefore, each metal pipe can be smoothly moved in its axial direction inside the corresponding supporting portion, that is, the cover and the pump unit can be smoothly moved relatively to each other.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE PRESENTLY PREFERRED EMBODIMENTS

Embodiments of the present invention will be described in detail with reference to the accompanying drawings.

(First Embodiment)

Figure 1:
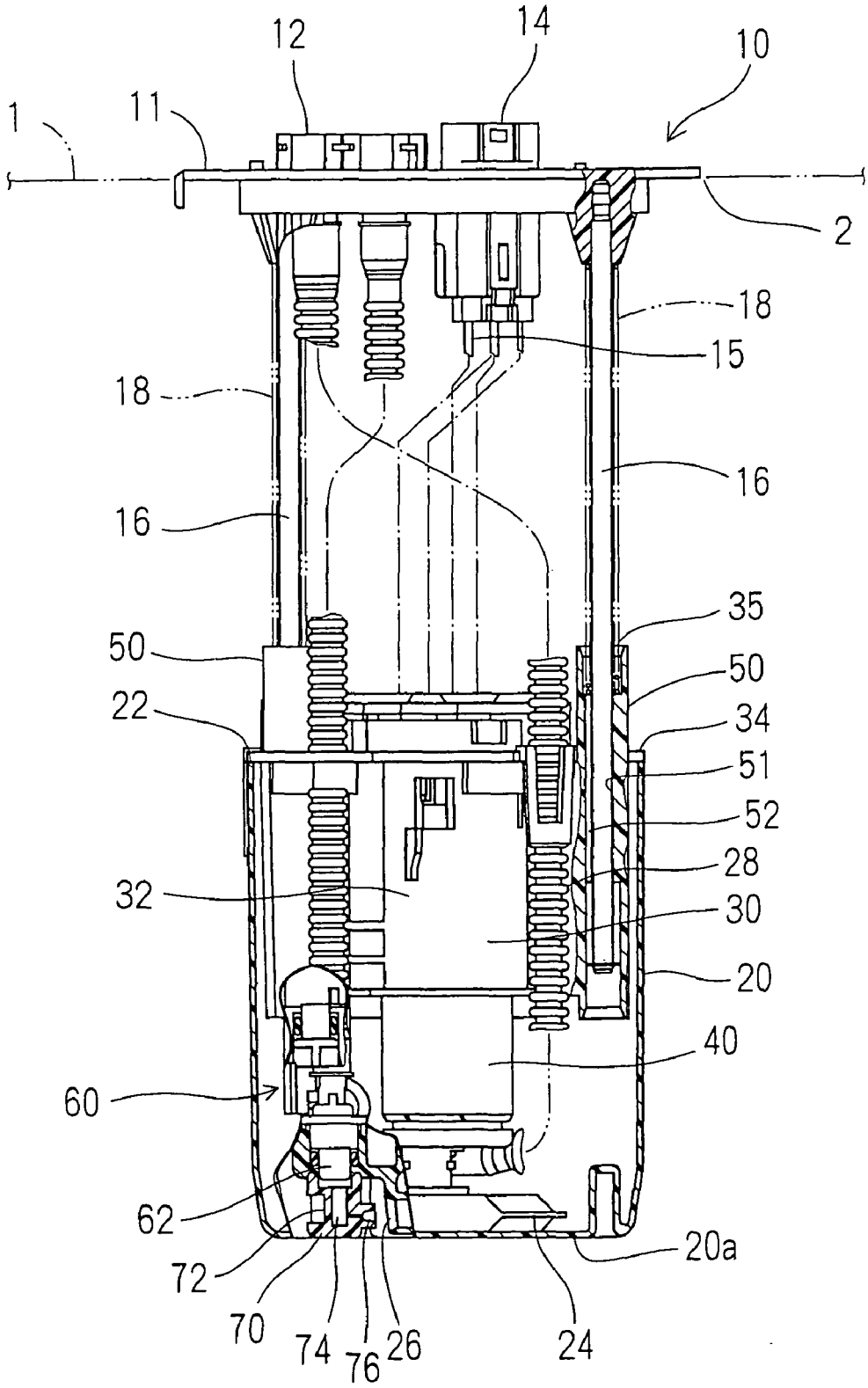
FIG. 1 is a partially cross-sectional view of a fuel supply system according to the first embodiment of the present invention.

FIG. 1 shows a fuel supply system 10 according to the first embodiment of the present invention. The fuel supply system 10 has a disc-shaped cover (flange) 11. The cover 11 is fastened to an upper wall of an integrally resin-made fuel tank 1 (not shown) so that the fuel supply system 10 is installed inside the fuel tank 1. Except for the cover 11, covering an opening 2 of the fuel tank 1, components of the fuel supply system 10 are stored inside the fuel tank 1.

The cover 11 has a fuel outlet 12 and an electric connector 14. Fuel stored in a fuel pump 40, installed inside a sub-tank 20, is discharged through the fuel outlet 12 into outside of the fuel tank 1. Electricity is supplied to the fuel pump 40 from the electric connector 14 through lead wires 15.

The cover 11 and a case cover 34 are connected by metal pipes 16, which are made of, for example, stainless steel or aluminum. One end of each metal pipe 16 is fastened to the cover 11, and the other end of which is movably supported by a case cover 34. The case cover 34 is disposed on an upper surface of a filter case 32. The filter case 32 is a component of a pump unit. The pump unit includes a fuel filter 30, the fuel pump 40, a pressure regulator 60, and so on. Springs 18 are provided, and one end of each spring 18 is fastened to the cover 11, and the other end of which is fastened to the case cover 34. The springs 18 bias the cover 11 and the case cover 34 so as to be drawn apart. The case cover 34, integrally formed with the filter case 32, is locked at a stepped portion 22 formed in an inner periphery of the opening of the sub-tank 20, and thereby the filter case 32 is restricted from moving downward inside the sub-tank 20. In addition, the filter case 32 can be moved integrally with the sub-tank 20, and the fuel pump 40 can be moved in the axial direction of the metal pipe 16 relatively to the cover 11. Therefore, even though the fuel tank 1, which is made of resin, is expanded or contracted by force of the change of the inner pressure caused by the alternation of the temperature or the alternation of the amount of fuel, a bottom 20*a* of the sub-tank 20 is constantly pressed on the inner bottom surface of the fuel tank 1.

Inside the sub-tank 20, a suction filter 24, the fuel filter 30, the fuel pump 40, the pressure regulator 60, and so on are stored. The suction filter 24 filters larger dusts in the fuel sucked by the fuel pump 40 from the sub-tank 20. The pressure regulator 60 regulates the pressure of the fuel that is discharged from the fuel pump 40 into a predetermined level. The fuel filter 30 filters smaller dusts in the fuel discharged from the fuel pump 40 through the use of its filter element (not shown).

The fuel pump 40 is stored in the sub-tank 20. The fuel pump 40 sucks the fuel from its lower end portion and discharges the fuel from its upper end portion. The fuel pump 40 has a motor (not shown) and generates fuel suctioning force by an impeller driven by the motor. A fuel outlet (not shown) of the fuel pump 40 is fitted in a fuel inlet (not shown) of the filter case 32.

The pressure regulator 60 regulates the pressure of the fuel that flows from the fuel pump 40 through a corrugated tube 28 into the fuel outlet 12. A fuel inlet (not shown) of the pressure regulator 60 is fit in a fuel outlet (not shown) of the filter case 32. In the bottom 20*a* of the sub-tank 20, a fuel inlet 72 of a jet pump 70 is formed and fits in a fuel outlet 62 of the pressure regulator 60.

The jet pump 70 is installed in an outer portion of the sub-tank 20, for example, by means of ultrasonic bonding. A fuel passage 74 of the jet pump 70 is communicated with a fuel passage in the fuel inlet 72. Superfluous fuel, which is discharged from the fuel outlet 62 of the pressure regulator 60 while the pressure regulator 60 regulates the pressure of the fuel that flows from the fuel filter 30 through fuel line 28 into the fuel outlet 12, passes through the fuel inlet 72 and the fuel passage 74 and thereafter is jetted from a nozzle 76 of the jet pump 70 toward a fuel inlet 26 formed in the sub-tank 20. While the fuel is jetted from the nozzle 76, suctioning force is generated around the nozzle 76 and around the fuel inlet 26. Accordingly, by virtue of the suctioning force, the fuel inside the fuel tank 1 is sucked into the sub-tank 20. In this way, even though the amount of the fuel inside the fuel tank 1 decreases, the sub-tank 20 is filled with the fuel.

The case cover 34 has cylindrical supporting portions 50, each of which has a through hole 35. The supporting portions 50 are made of resin and integrally formed with the case cover 34. Most part of each supporting portion 50 is disposed inside the sub-tank 20.

Figure 2:
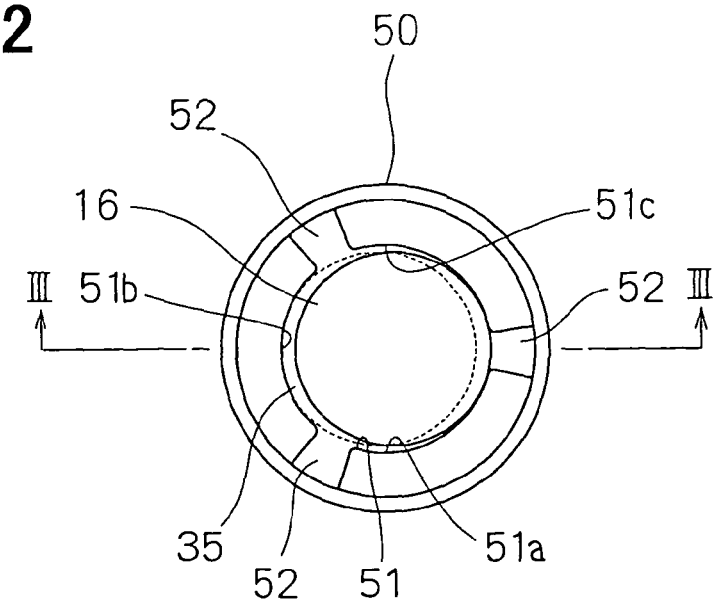
FIG. 2 is a plan view of a supporting portion of the fuel supply system according to the first embodiment of the present invention.
Figure 3:
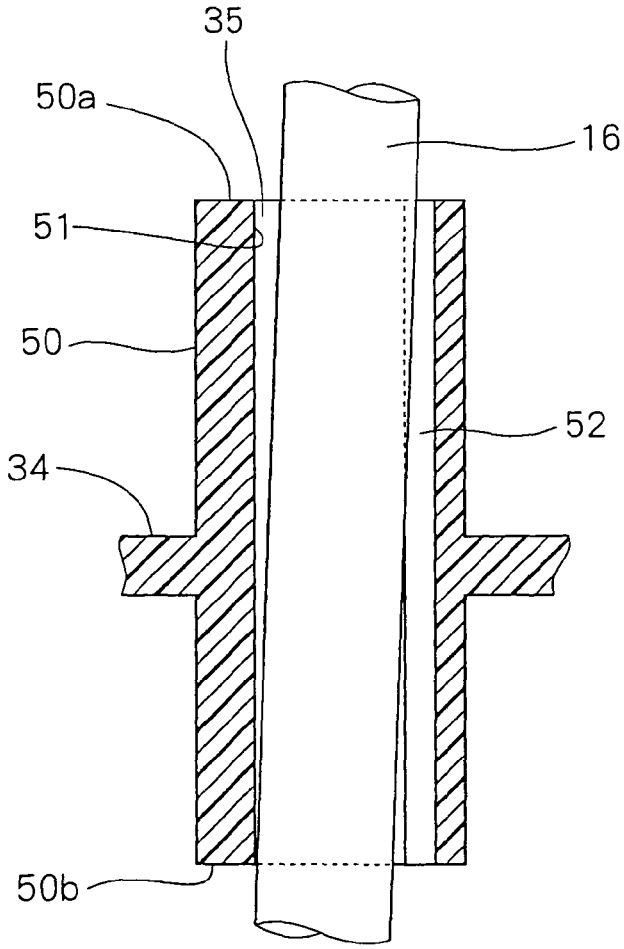
FIG. 3 is a cross-sectional view of a part of the supporting portion, taken along a line III—III of FIG. 2, of the fuel supply system according to the first embodiment of the present invention.

In each supporting portion 50, the corresponding metal pipe 16 is inserted movably in its axial direction. The metal pipe 16 is moved inside the through hole 35 slidably relative to an inner surface 51 of the supporting portion 50. Accordingly, the inner surface 51 guides the metal pipe 16 so as to be moved in its axial direction. As shown in FIG. 2, each supporting portion 50 has three grooves 52 recessed in the inner surface 51 to divide the inner surface 51 into three surface subsections 51*a*–51*c*. The grooves 52 are spaced equally in a circumferential direction of the supporting portion. As shown in FIG. 3, each of the grooves 52 extends from one end 50*a* of the supporting portion 50 located on the cover 11 side to the other end 50*b* of the supporting portion 50 located on the side opposite from the cover 11 in the axial direction of the supporting portion 50. Accordingly, in the case where the case cover 34 is integrally made of resin, the supporting portion 50 and the grooves 51 can be made integrally with the case cover 34 through the use of one molding tool.

Figure 4:
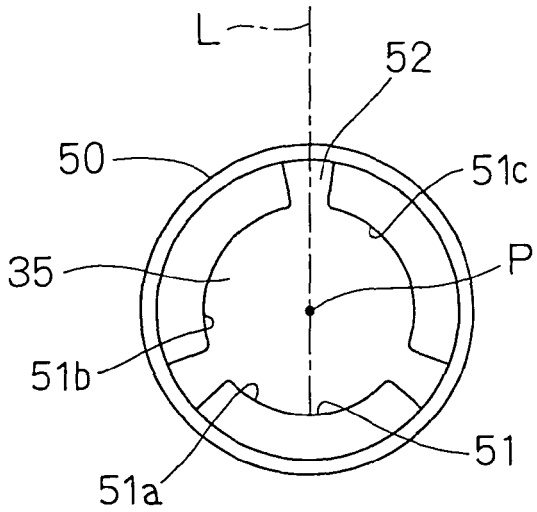
FIG. 4 is an illustrative plan view of the supporting portion of the fuel supply system according to the first embodiment of the present invention.

As shown in FIG. 4, each groove 52, a central axis P of the through hole 35 and a corresponding one of the surface sub-sections 51*a*, 51*b*, 51*c* are aligned along an imaginary line L in a plane perpendicular to the central axis P of the through hole 35. In the arrangements of the grooves 52, as shown in FIG. 3, when the metal pipe 16 leans so that a part thereof contacts one part of the inner surface 51 (specifically, one of the surface subsections 51*a*–51*c*) around the end 50*b* of the supporting portion 50, and a part of one of the grooves 52 contacts the other part of the metal pipe 16 at the end 50*a* of the supporting portion 50. Accordingly, at the end 50*a* of the supporting portion 50, the contacting areas of the metal pipe 16 and the inner surface 51 are small. Therefore, contact resistance between the metal pipe 16 and the supporting portion 50 is reduced.

However, in the case where one of the grooves 52, the central axis P and the other one of the grooves 52 are aligned along the imaginary line L in the plane perpendicular to the central axis P, it could happen that a part of the metal pipe 16 contacts the one of the surface sub-sections 51*a*, 51*b*, 51*c* at the end 50*a*, and the other part of the metal pipe 16 contacts the other one of the surface sub-sections 51*a*, 51*b*, 51*c* at the end 50*b*. Therefore, positional relation of the grooves 52 and the parts of the inner surface 51 are defined as shown in FIG. 4.

As described above, in the first embodiment of the present invention, since the grooves 52 are formed in the inner surface 51 of the supporting portion 50, the contact areas between the metal pipe 16 and the supporting portion 50, which are slidably moved, are reduced. Accordingly, when the metal pipe 16 is leaned inside the supporting portion 50, contacting areas of the metal pipe 16 and the supporting portion 50 can be reduced. Therefore, the metal pipe 16 can be smoothly moved inside the through hole 50 in its axial direction, and thereby the sub-tank 20, storing the fuel pump and so on, can be smoothly moved relatively to the cover 11.

Moreover, since the supporting portions 50 are made of resin, and the metal pipes 16 are made of metal, abrasions of the supporting portions 50 and the metal pipes 16 can be reduced. Besides, when the supporting portion 50 and the metal pipe 16 are conflicted, noises are less likely to be generated. Moreover, a plurality of grooves 52 is formed in the inner surface of each supporting portion 50 at predetermined positions. Therefore, at least a part of each metal pipe 16 contacts a part of one of the grooves 52 irrespectively of the leaning direction of the metal pipe 16 inside the supporting portion 50.

Moreover, through the use of the grooves 52 of each supporting portion 50, dusts that have entered between the supporting portion 50 and the metal pipe 16 can be discharged. Therefore, the metal pipe 16 and the supporting portion 50 are restricted to be damaged by the dusts. That is, the abrasions of the metal pipes 16 and the supporting portions 50 can be reduced.

(Second Embodiment)

Figure 5:
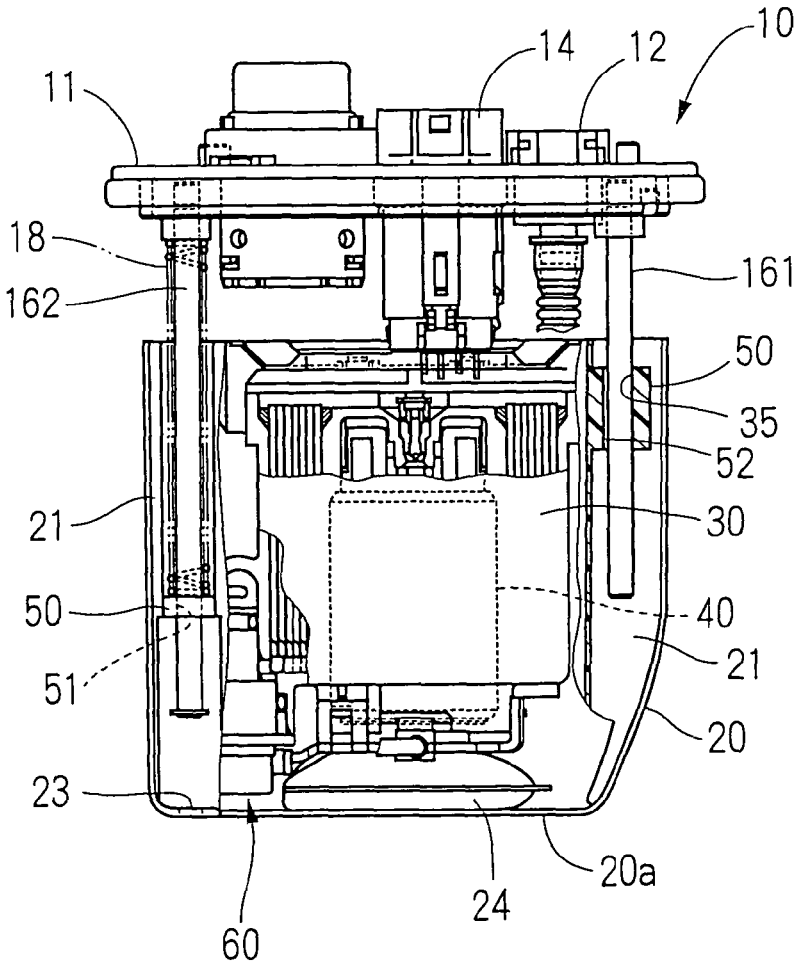
FIG. 5 is a partially cross-sectional view of a fuel supply system according to the second embodiment of the present invention.

FIG. 5 shows a fuel supply system 10 according to the second embodiment of the present invention. The components of the second embodiment essentially the same as those of the first embodiment are indicated by the numerals the same as the first embodiment, and the further explanations of which are abbreviated.

A fuel supply system 10 according to the second embodiment of the present invention includes a cover 11 and a pump unit. The pump unit is supported by metal pipes 161, 162, the ends of which are fixed in the cover 11, movably in the axial direction of the metal pipes 161, 162. The pump unit includes a sub-tank 20, a fuel filter 30 and a fuel pump 40. The fuel filter 30 and the fuel pump 40 are stored inside the sub-tank 20 having a bottom.

Figure 6:
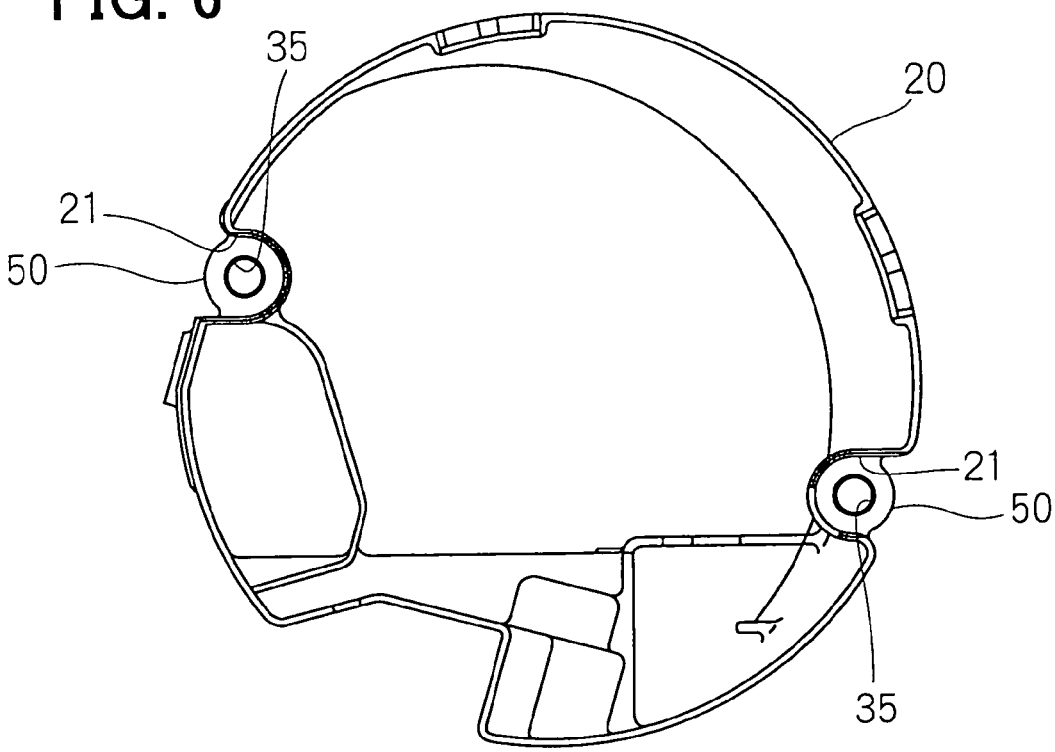
FIG. 6 is a schematically plan view of a sub-tank of the fuel supply system according to the second embodiment of the present invention.
Figure 8:
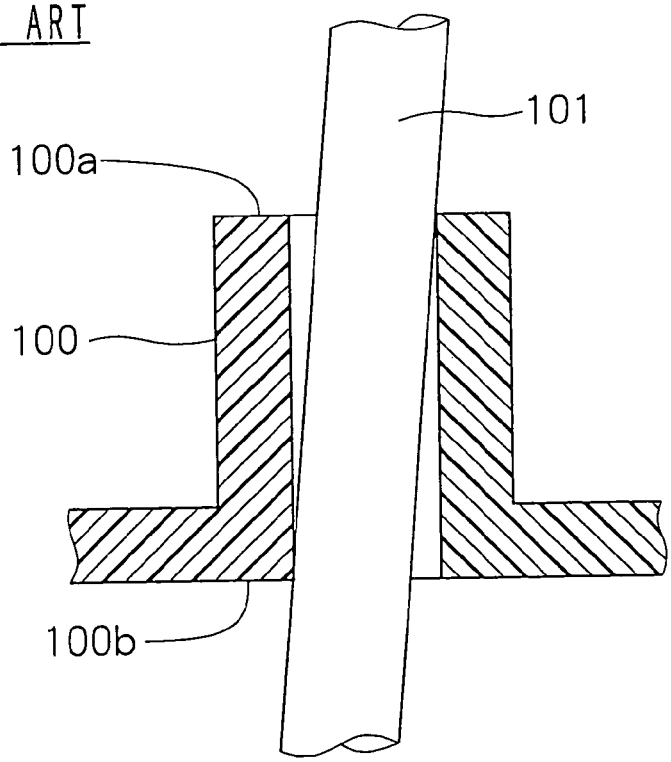
FIG. 8 RELATED ART
FIG. 8 is a cross-sectional view of a part of a supporting portion of a fuel supply system according to a related art.

As shown in FIG. 6, the sub-tank 20 has a substantially cylindrical shape and two recesses 21. The recesses 21 are disposed at substantially the same intervals around the circumference of the sub-tank 20. Substantially cylindrical supporting portions 50 to be inserted through by the metal pipes 161, 162 are disposed inside the respective recesses 21. That is, the supporting portions 50 are disposed outside the sub-tank 20.

The through holes 35, formed in the supporting portions 50, respectively store the metal pipes 161, 162 movably in the axial direction of the metal pipes 161, 162. The metal pipes 161, 162 are moved slidably with the inner surfaces of the supporting portions 50. Accordingly, the inner surfaces of the supporting portions 50 guide the metal pipes 161, 162 so as to be moved in the axial direction of the metal pipes 161, 162. Similar to the first embodiment, in the inner surface of each supporting portion 50, a plurality of grooves 52 is formed. The shapes and positions of the grooves 52 are the same as those of the first embodiment.

As shown in FIG. 5, the sub-tank 20 has a projection 23 in its bottom 20*a*. The projection 23 is positioned in one of the recesses 21 and projects outward. Moreover, the peripheral end of the projection 23 is positioned in the largest circumscribing circle of the outer periphery of the sub-tank 20 or inside the circumscribing circle. Accordingly, when the metal pipe 162 is moved downward in its axial direction inside the supporting portion 50, and the lower end of the metal pipe 162 contacts the projection 23, the metal pipe 162 is restricted to be moved lower than projection 23.

The cover 11 has a plurality of components, projecting toward the sub-tank 20, for example, an electric connector 14. Inside the sub-tank 20, e.g., the fuel filter 30 and the fuel pump 40 are stored. The fuel tank 1, in which the fuel supply system 10 is stored, is expanded or constricted, for example, by force of the pressure of fuel in the fuel tank 1. Therefore, when the fuel tank 1 is constricted, the cover 11 and the sub-tank 20 are moved to be close to each other. Moreover, when the cover 11 and the sub-tank 20 are approximated at a predetermined interval, the components projecting from the cover 11 and components stored in the sub-tank 20 are clashed. Accordingly, there is a possibility that the components projecting from the cover 11 or lead wires 15 are broken.

In case the supporting portions 50 are disposed outside the sub-tank 20, the lower end of the metal pipe 162 does not contact the bottom 20*a* of the sub-tank 20. That is, the sub-tank 20 is not restricted to excessively approximate the cover 11. Therefore, in the fuel supply system 10 according to the second embodiment, the projection 23 is provided to stopping the lower end of the metal pipe 162. When the sub-tank 20 is approximated to the cover 11 at the predetermined interval, the lower end of the metal pipe 162 contacts the projection 23. Accordingly, the sub-tank 20 is restricted to excessively approximate the cover 11.

In the fuel supply system 10 according to the second embodiment, the supporting portions 50 for respectively supporting the metal pipes 162 are disposed outside of the sub-tank 20. Recently, the fuel supply system 10 is required to be downsized, and therefore the sub-tank 20, in which the fuel filter 30 and the fuel pump 40 and so on are stored, is required to be downsized. However, the cover 11 needs to be fitted in the opening 2 of the fuel tank 1 so as to close the opening 2. Accordingly, the outer diameter of the sub-tank 20 is smaller than that of the cover 11, and therefore the supporting portions 50 are required to be disposed outside the sub-tank 20. In this way, the cover 11 need not be deformed to attach the metal pipes 161, 162 thereto, and only the sub-tank 20 can be downsized. Consequently, in consideration of the shapes of the cover 11 and the sub-tank 20, the sub-tank 20 can be formed so that the supporting portions 50 are disposed inside or outside of the sub-tank 20, that is, the fuel supply system 10 can be easy to be designed.

Moreover, the recesses 21 are formed in the sub-tank 20, and the supporting portions 50 are disposed therein. Accordingly, the supporting portions 50 do not project from the outer surface of the sub-tank 20, and thereby the sub-tank 20 can be formed with a substantially cylindrical shape. In this way, even though the supporting portions 50 are disposed outside the sub-tank 20, the fuel supply system 10 is not enlarged.

Moreover, the projection 23 is formed in the sub-tank 20, and thereby the sub-tank 20 is restricted to excessively approximate the cover 1. Accordingly, the components projecting from the cover 11 and the components stored in the sub-tank 20 are prevented to be clashed.

OTHER EMBODIMENTS

Figure 7:
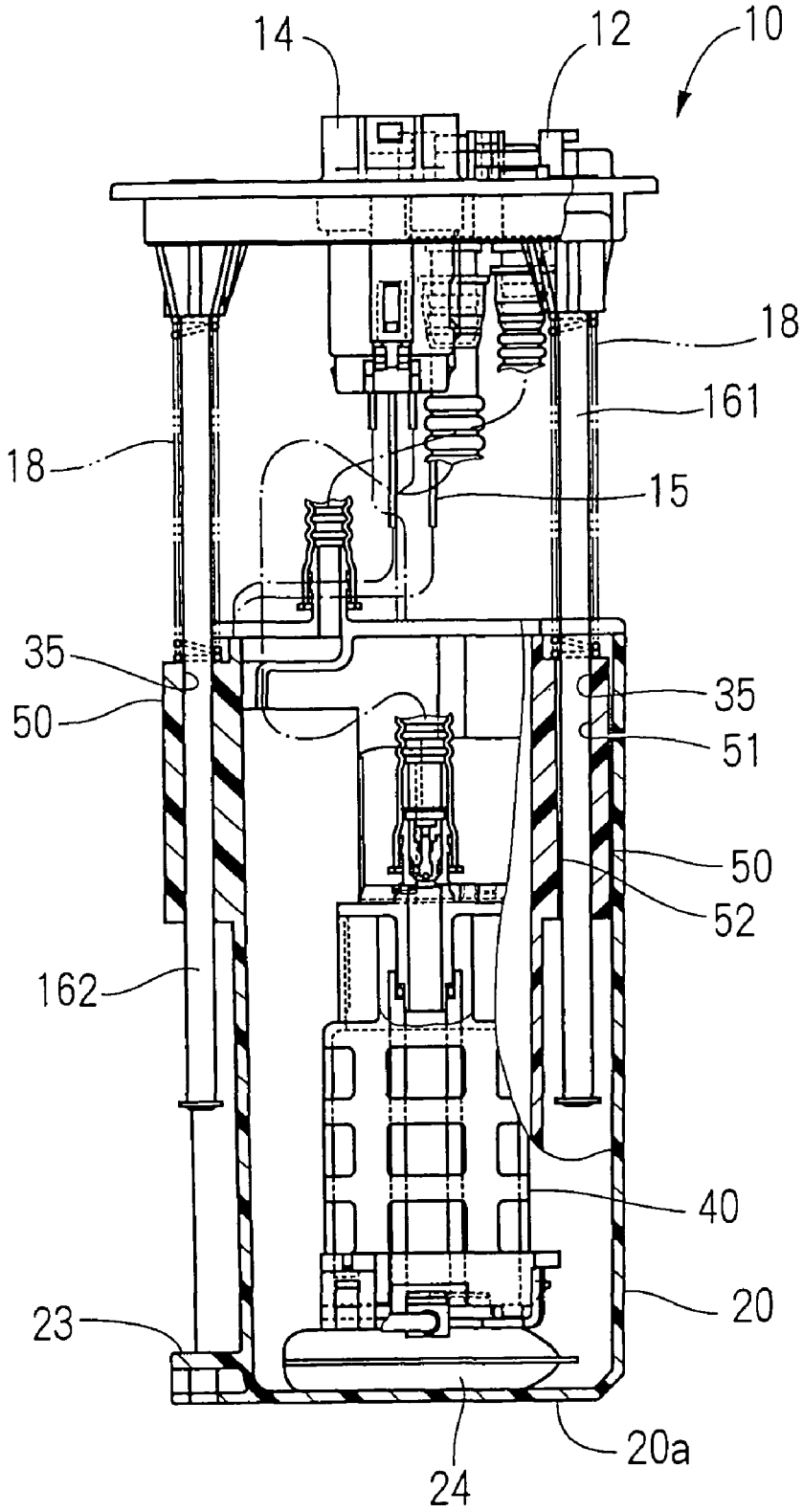
FIG. 7 is a partially cross-sectional view of a fuel supply system according to one of other embodiments of the present invention.

In the fuel supply system 10 according to the first embodiment or the second embodiment, the sub-tank 20 has the fuel pump 40 including the fuel filter 30. However, in the fuel supply system 10 according to the third embodiment, as shown in FIG. 7, a sub-tank 20 may not include a fuel pump 40.

Moreover, three grooves 52 are formed in each supporting portion 50 to be equally spaced. However, the grooves 52 need not be spaced equally, and moreover two or lower or four or more grooves 52 may be formed in each supporting portion 50.

Moreover, two supporting portions 50 are disposed inside the sub-tank 20 in the first embodiment, and two supporting portions 50 are disposed outside the sub-tank 20. However, one of the supporting portions 50 may be disposed inside the sub-tank 20, and moreover the other one of the supporting portions 50 may be disposed outside the sub-tank 20.

Moreover, in the second and the third embodiments, the projection 23 is formed in the bottom 20*a* of the sub-tank 20. However, the projection 23 may be formed in a position other than the bottom 20*a*, and thereby the movable range of the metal pipe 16 inside the supporting portion 50 may be defined according to need.

What is claimed is:

1. A fuel supply system installed inside a fuel tank to supply fuel out of the fuel tank, the fuel supply system comprising:

a cover, which is attached to the fuel tank;

a pump unit that includes an electric fuel pump, which pumps fuel;

and a connecting member, which connects between the cover and the pump unit in a manner that allows relative movement between the cover and the pump unit, wherein the pump unit further includes a supporting portion, which has:

a through hole that penetrates through the supporting portion and axially slidably receives the connecting member in a reciprocable manner; and a plurality of grooves extending in an axial direction of the through hole and that are recessed in an inner peripheral surface of the supporting portion and, which are slidably engageable with the connecting member.

2. The fuel supply system according to claim 1, wherein:

the inner peripheral surface of the supporting portion is divided into a plurality of surface sub-sections by the grooves; and each groove, a central axis of the through hole and a corresponding one of the surface sub-sections are aligned along an imaginary line in a plane perpendicular to the central axis of the through hole.

3. The fuel supply system according to claim 1, wherein a material of the connecting member is different from a material of the supporting portion.

4. The fuel supply system according to claim 1, wherein the pump unit further includes a sub-tank, which receives the fuel pump.

5. The fuel supply system according to claim 4, wherein the supporting portion is disposed inside the sub-tank.

6. The fuel supply system according to claim 4, wherein the supporting portion is disposed outside the sub-tank.

7. The fuel supply system according to claim 6, wherein:

the sub-tank includes a recess, which is formed by radially inwardly recessing a portion of an outer peripheral wall of the sub-tank; and the supporting portion is positioned in the recess.

8. The fuel supply system according to claim 6, wherein the sub-tank has a projection, which projects radially outward from the sub-tank and is engageable with an end of the connecting member, which is opposite from the cover.

* * * * *